US006567738B2

(12) United States Patent
Gopp et al.

(10) Patent No.: US 6,567,738 B2
(45) Date of Patent: May 20, 2003

(54) FUELING CONTROL SYSTEM

(75) Inventors: Alexander Y. Gopp, Ann Arbor, MI (US); John Ottavio Michelini, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 255 days.

(21) Appl. No.: 09/772,549

(22) Filed: Jan. 30, 2001

(65) Prior Publication Data

US 2002/0184876 A1 Dec. 12, 2002

(51) Int. Cl.[7] ..... F02D 41/14
(52) U.S. Cl. ..... 701/109; 60/276; 123/691
(58) Field of Search ..... 701/109; 60/276; 123/305, 691

(56) References Cited

U.S. PATENT DOCUMENTS

| | | | |
|---|---|---|---|
| 5,090,199 | A | 2/1992 | Ikuta et al. |
| 5,115,639 | A | 5/1992 | Gopp |
| 5,319,921 | A | 6/1994 | Gopp |
| 5,473,889 | A | 12/1995 | Ehard et al. |
| 5,615,550 | A | 4/1997 | Ogawa et al. |
| 5,735,245 | A | 4/1998 | Kubesh et al. |
| 5,832,724 | A | 11/1998 | Watanabe et al. |
| 6,026,795 | A | 2/2000 | Poggio et al. |

*Primary Examiner*—Andrew M. Dolinar
(74) *Attorney, Agent, or Firm*—Allan J. Lippa; John D. Russell

(57) ABSTRACT

A method for controlling air-fuel ratio of an engine coupled to an emission control device uses an upstream linear exhaust gas sensor and a switching downstream exhaust gas sensor. During stoichiometric operation, both sensors are used for feedback control. During operation away from stoichiometry, the downstream sensor feedback is disabled.

13 Claims, 4 Drawing Sheets

FUELING CONTROL SYSTEM

FIELD OF THE INVENTION

The present invention relates to a combined lean burn and stoichiometric fuel control for an automotive internal combustion engine.

BACKGROUND OF THE INVENTION

Engine air-fuel ratio control typically uses an exhaust gas oxygen sensor for feedback control. One system shows a "linear" exhaust gas sensor upstream of catalyst and a "switching" exhaust gas sensor downstream of the catalyst. In this system, the "switching" sensor is used to monitor the catalyst and the "linear" sensor. Further, the "switching" sensor is used for air-fuel control during engine start until the "linear" sensor reaches its operating temperature. However, whenever the "linear" sensor attains the activation temperature, it is utilized to control engine air-fuel ratio. Such a method is described U.S. Pat. No. 5,832,724.

The inventors herein have recognized a disadvantage of the above approach. In particular, the "linear" sensor has less accuracy in determining the point of stoichiometry than the "switching" sensor. This is generally because the "linear" sensor is designed to provide a signal indicative of actual air-fuel ratio over a wide air-fuel ratio range, whereas the "switching" sensor is designed to produce a very large change ("switch") at the point of stoichiometry. Thus, when operating near stoichiometry, such a system provides degraded performance.

SUMMARY OF THE INVENTION

Disadvantages of prior approaches are overcome by a system for controlling engine air-fuel ratio entering an emission control device comprising: a switching exhaust gas sensor located downstream of the emission control device; a linear exhaust gas sensor located upstream of the emission control device; and a controller adjusting a fuel injection amount into the engine based on both said switching exhaust gas sensor and said linear exhaust gas sensor when operating near stoichiometry; and adjusting said fuel injection amount into the engine based on said linear exhaust gas sensor and independent of said switching exhaust gas sensor when operating away from stoichiometry.

By utilizing both the switching sensor and linear sensor when operating near stoichiometry, it is possible to improve the accuracy of the air-fuel ratio control system. Further, with the same system, it is possible to retain a linear sensor to provide accurate air-fuel ratio control away from stoichiometry.

An advantage of the above aspect of the present invention is improved emissions and improved fuel economy.

BRIEF DESCRIPTION OF THE DRAWINGS

The advantages of the invention claimed herein will be more readily understood by reading an example of an embodiment in which the invention is used with reference to the following drawings wherein:

DESCRIPTION OF THE INVENTION

Figure 1:
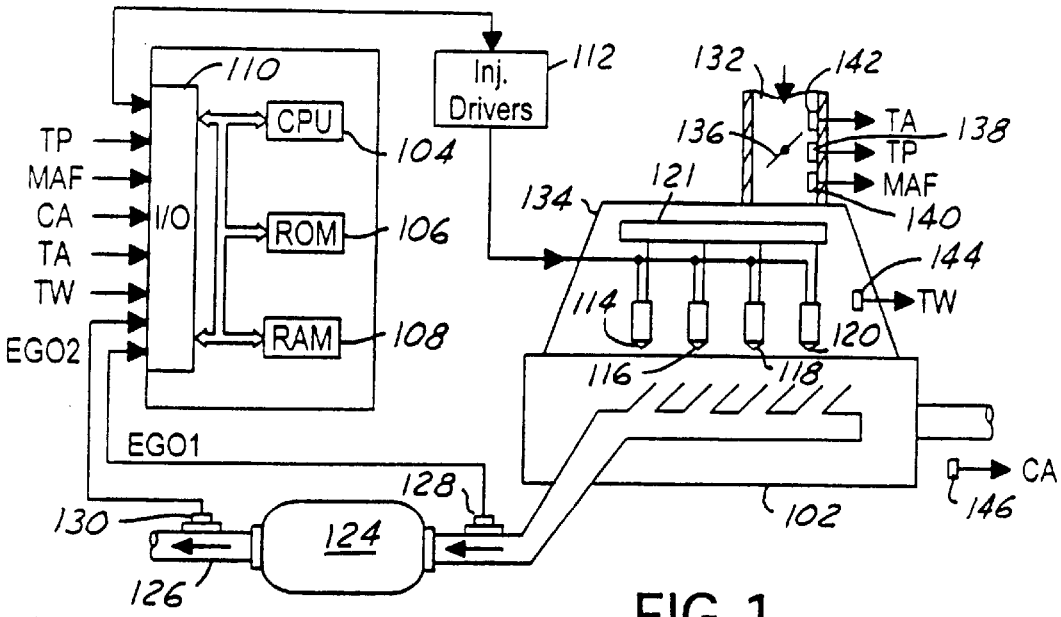
FIG. 1 is a schematic view of an internal combustion engine including an embodiment of this invention.

In the following Figures, the same reference numerals will be used to identify identical components in the various views. The present invention is illustrated with respect to a lean burn fuel system using a Universal Exhaust Gas Oxygen (UEGO) sensor ["linear exhaust gas sensor"], particularly suited for the automotive field.

Referring to FIG. 1, microcomputer 100 is shown for controlling an air/fuel ratio supplied to an internal combustion engine 102. Microcomputer 100 further comprises a central processing unit (CPU) 104, a read-only memory (ROM) 106 for storing main routine and other routines such as a fuel flow routine and calibration constants, tables, etc., a random access memory (RAM) 108, and a conventional input/output (I/O) interface 110. Interface 110 includes analog to digital (A/D) converters for converting various analog input signals and digital inputs, digital to analog (D/A) converters for converting various analog output signals and digital outputs.

Microcomputer 100 also includes conventional elements such as a clock generator and means for generating various clock signals, counters, drivers, and the like (not shown). Microcomputer 100 controls the air/fuel ratio by energizing injector drivers 112 in response to various measured operating parameters of engine 102. Microcomputer 100 can fetch input parameters and can perform calculations of control signals at a fixed sampling rate DELTAT such as, for example, 20 msec. If microcomputer 100 is designed to operate with a variable sampling rate, a timer can be provided which can perform time measurement between two successive samplings and assign measured sampling time to DELTAT.

Engine 102, in this particular example, is shown as a conventional four cylinder gasoline engine having fuel injectors 114, 116, 118, and 120 coupled to a fuel rail 121. Each fuel injector is electronically activated by respective signals from injector drivers 112. Each of the injectors 114, 116, 118, and 120 is also coupled in a conventional manner to respective combustion cylinders 1, 2, 3, and 4 (not shown). Exhaust gases from each of the combustion cylinders 1, 2, 3, and 4 are routed to an exhaust manifold 122 and are discharged through an emission control device 124 which removes CO, HC, and NOx from the exhaust gas, and exhaust pipe 126. Emission control device 124 operates to retain oxidants (NOx and O2) during lean operating, and releases the retained oxidants during rich operation, where the incoming reductants react with the released oxidants.

Provided in the concentration portion of the exhaust manifold 122, upstream of the catalyst 124, is a UEGO (UEGO) sensor 128 for detecting an oxygen concentration in the engine exhaust gases, which provides an output proportional to exhaust air-fuel ratio concentration over a wide range of air-fuel ratios. Further provided in the exhaust pipe 126, downstream of the catalyst 124, is an EGO sensor 130 ["switching" exhaust gas sensor] for detecting an oxygen concentration after catalyst 124. EGO sensor provides an abrupt change in output voltage at the point of stoichiometry. Both the UEGO and EGO sensors 128 and 130 generate output voltage signals that are transmitted to the A/D converter of I/O interface 110.

Intake air port 132 is shown coupled to intake manifold 134 for inducting air past throttle plate 136 into combustion cylinders. Throttle position sensor 138 is shown coupled to throttle plate 136 for providing a throttle position signal TP. Also coupled to intake manifold 134 are mass airflow sensor 140 for providing mass airflow signal MAF related to the mass airflow induced into engine, and air temperature sensor 142 for providing a signal TA indicative of the temperature of induced air. Coupled to a cylinder block of engine 102 is a cooling water temperature sensor 144 for providing signal TW indicative of the coolant temperature. Crank angle position sensor 146 is shown coupled to a crankshaft of engine 102 for providing crank angle position signal CA indicative of crank position.

A manifold pressure sensor MAP may be used instead of a mass airflow sensor 140 to provide an indication of engine load by known techniques. Other conventional components necessary for engine operations such as a spark delivery system are not shown in FIG. 1. It is also recognized that the invention may be used to advantage with other types of engines, such as engines having a number of cylinders other than four. Further a direct injection engine may be used with the present invention.

Figure 2:
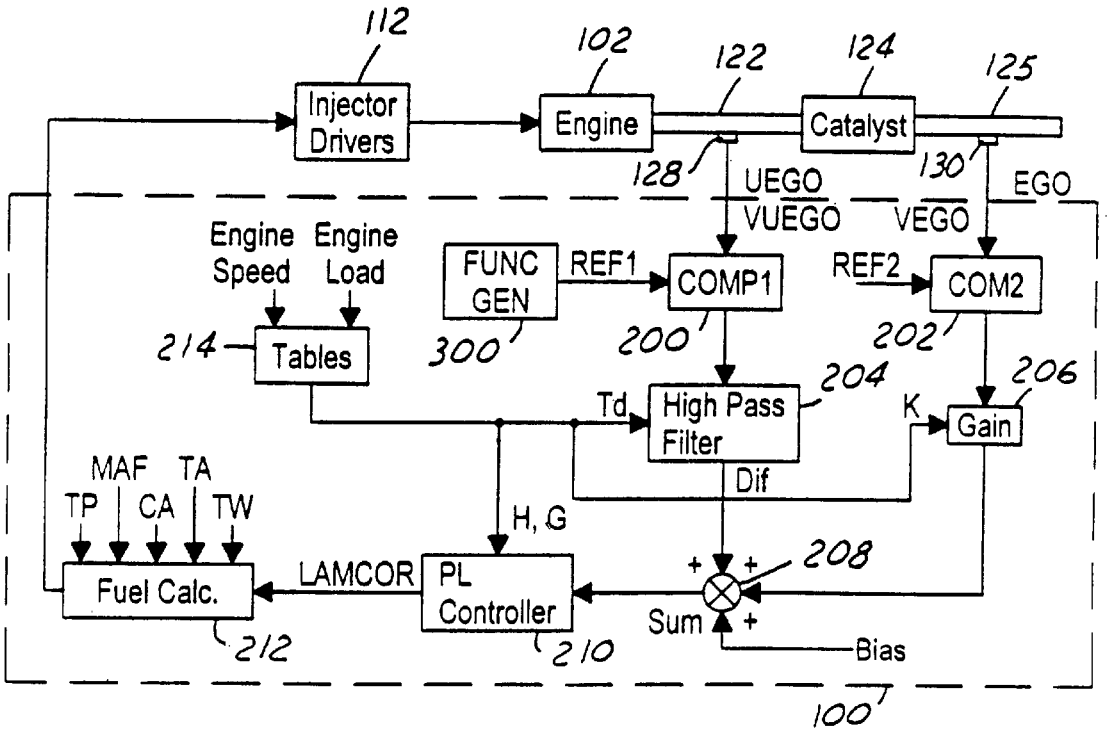
FIG. 2 is a control block diagram of an upstream UEGO and downstream EGO sensor closed loop fuel control system according to the invention.
Figure 3:
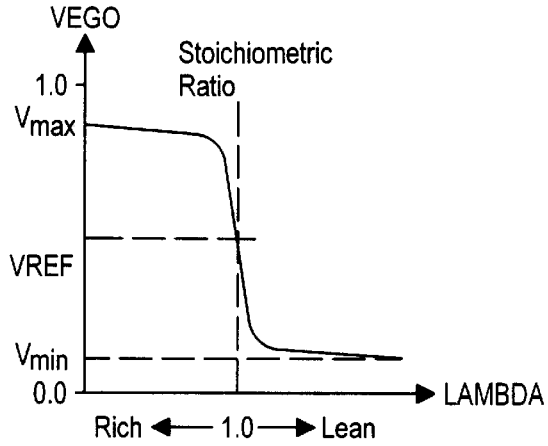
FIG. 3 is a graph showing typical voltage output of an EGO sensor as a function of air/fuel ratio.
Figure 6:
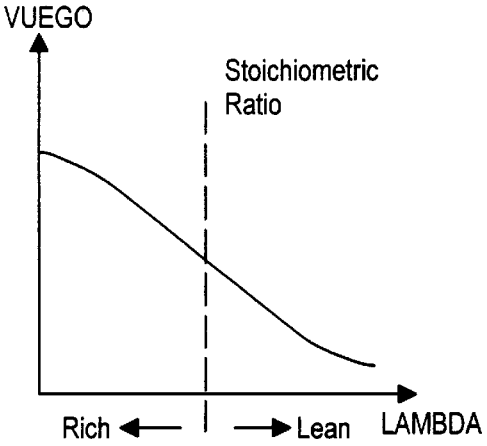
FIG. 6 is a graph showing typical voltage output of an UEGO sensor as a function of air/fuel ratio.

The operation of a UEGO and EGO sensor closed loop fuel control system in controlling air/fuel ratio is now described with particular reference to a control block diagram shown in FIG. 2, the associated graph in FIG. 3 showing EGO sensor output voltage VEGO versus LAMBDA, an air/fuel ratio relative to air/fuel stoichiometric ratio, and the associated graph in FIG. 6 showing UEGO sensor output voltage VUEGO versus LAMBDA. In FIG. 2, microcomputer 100, engine 102, injector drivers 112, exhaust manifold 122, catalyst 124, exhaust pipe 125, and UEGO and EGO sensors 128 and 130 have been previously described with reference to FIG. 1.

Output voltages VUEGO and VEGO from upstream UEGO sensor 128 and downstream EGO sensor 130 are fed through A/D converter (not shown) to respective comparators 200 and 202. Each comparator is supplied with reference signals REF1 and REF2, respectively, which are indicative of an EGO output voltage at stoichiometric ratio as shown in FIG. 3. Each comparator 200 and 202 produces an output signal COMP1 and COMP2 respectively in such a way that their absolute values are equal but vary in sign depending upon which side of stoichiometric ratio are EGO output voltage signals VUEGO and VEGO respectively. The output COMP1 of comparator 200 is modified by corrective block 204. Corrective block 204 is advantageously a high pass filter, which in this embodiment is presented as a first order high pass filter but is not limited to be a first order filter and may be a higher order high pass filter. Also note that high pass filter includes filters who simply have a high pass filter component. In other words, a filter may have both high pass and low pass characteristics. Those skilled in the art will recognize that any filter with zeros in the numerator of the transfer function may constitute a high pass filtering component of a filter. Further, a high pass filter may be present when the order of the numerator of the filter transfer function is greater than the order of the denominator. Also note that high pass filter is disabled during operation away from stoichiometry as described later herein with particular reference to FIG. 7.

The first order high pass filter, also known in the control field as a real time differentiator, may be described by the following differential equation:

$$T_d{*}d(DIF)/dt+DIF=d(COMP1)/dt \qquad \text{(Eqn. 1)}$$

where:

DIF—the first order high pass filter output signal;

$T_d$—time constant of said filter, calibratable parameter of the control system;

d( . . . )/dt—symbol indicating the first derivative of the respective signal.

The difference equation suited for digital microcomputer computations is derived from (Eqn. 1) and in the simplest form is:

$$DIF(i)=(1-DELTAT/Td)*DIF(i-1)+(COMP1(i)-COMP1(i-1))$$

where:

DELTAT—microcomputer sampling rate discussed above;

i and i−1 indicate current and previous results of calculations or measurements.

The output COMP2 of the second comparator 202 is connected to gain block 206 with a constant gain K so that output signal of comparator 202 is equal to K*COMP2. Output signals of both comparators 200 and 202 are summed together with an additional bias signal BIAS by a summing block 208. Said bias signal BIAS is provided for calibration purposes only serving to modify reference signal REF2 if so desired. The output signal SUM of the summing block is equal $$SUM=DIF+K*COMP2+BIAS \qquad \text{(Eqn. 2)}$$

and is fed to a controller block 210.

Controller block 210 performs calculation corresponding to proportional and integral (PI) controller which is described by the following differential equation:

$$d(LAMCOR)/dt=H*d(SUM)/dt+G*SUM \qquad \text{(Eqn. 3)}$$

where:

LAMCOR—output signal of PI controller which represents air/fuel ratio correction amount;

H and G—jumpback and ramp respectively of the PI controller, calibratable parameters of the control system.

The difference equation suited for digital microcomputer computations is derived from (Eqn. 3) and in the simplest form is: LAMCOR(i)=LAMCOR(i−1)+H*(SUM(i)−SUM(i−1))+G*DELTAT*SUM(i−1). Those skilled in the art will recognize that presentation of the differential equations (Eqn.1) and (Eqn.3) in the form of the difference equations may be done in different form. Control system calibratable parameters H, G, K, and Td may be modified as a function of speed/load tables (214). Also, though this description is related to microcomputer realization, the control system described so far can be easily converted to a realization by analog means, shown later.

Fuel calculation block 212 calculates fuel flow control signal in a conventional manner using an air/fuel correction amount LAMCOR, and provides signals to injector drivers 112. Function generator 300 is coupled to the first comparitor 200 and generates the first reference voltage. In other words, function generator 300 generates the desired air-fuel ratio reference for engine operating. When lean operation away from stoichiometry is desired, the function generator generates a value greater than 1. When rich operation away from stoichiometry is desired, the function generator generates a value less than 1. When near stoichiometric operation away from stoichiometry is desired, the function generator generates a value near or substantially 1.

Figure 4:
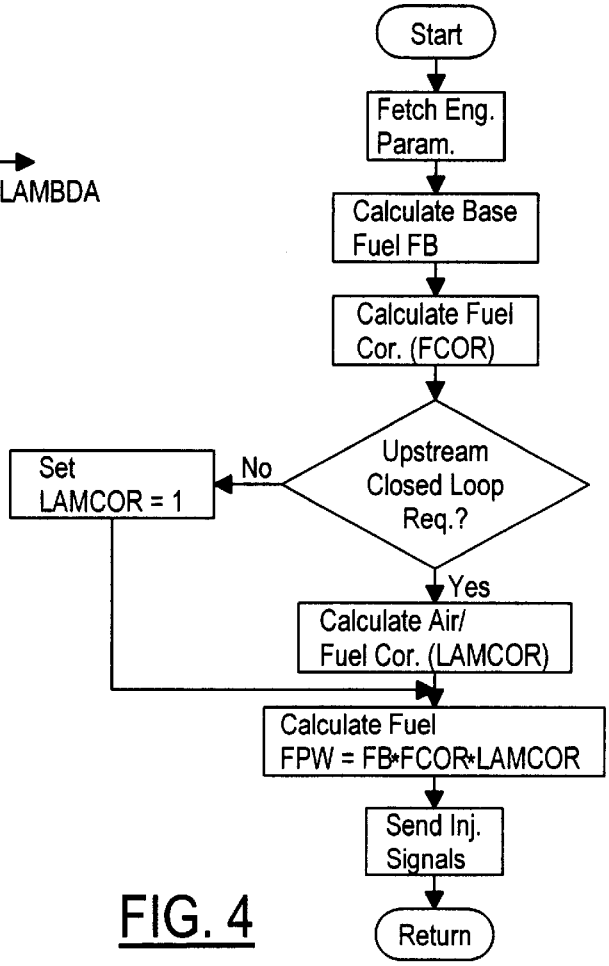
FIG. 4 is a flowchart illustrating various process steps performed to calculate fuel flow rate in accordance with an embodiment of this invention.

The operation of microcomputer 100 in controlling fuel flow is now described with particular reference to the flowchart shown in FIG. 4. The operations, or steps, described herein below are performed for each cylinder. However, cylinder identification and injector driver selection is not explicitly mentioned.

At the start of each sampling interval engine parameters are fetched in step 400. Engine speed and load are then computed in a conventional manner from crank position signal CA and mass airflow signal MAF. During step 402, base open loop fuel injection amount FB is determined by look-up and interpolation of speed/load table from ROM 106 storage. At step 404, fuel correction amount FCOR is calculated based on, for example, engine warming up temperatures of intake air TA and cooling water TW, battery voltage, and the like.

Step 406 checks if upstream UEGO sensor 128 is warmed-up to start closed loop operation and whether upstream closed loop control has been enables as described later herein with particular reference to FIG. 7. These conditions may be, but are not limited to, cooling water temperature TW reaching certain limit, inlet air temperature TA, observed EGO sensor switching, elapsed time since start, and the like. Also, some engine operations such as wide open throttle or prolonged idle may require open loop control even after other closed loop conditions are met. All these closed loop requirements are checked in step 406 and, if closed loop is called for, step 408 calculates air/fuel ratio correction amount LAMCOR. Otherwise, in step 410 LAMCOR is set to 1. Calculations of LAMCOR in step 408 will be explained later in more detail. Logic flow from both step 410 and 408 goes to step 412 which calculates a final fuel flow FPW based on the main fuel flow equation:

$$FPW=FB*FCOR*LAMCOR$$

and energizes fuel injectors in step 414. Step 416 returns fuel flow calculation routine to the main routine.

Figure 5:
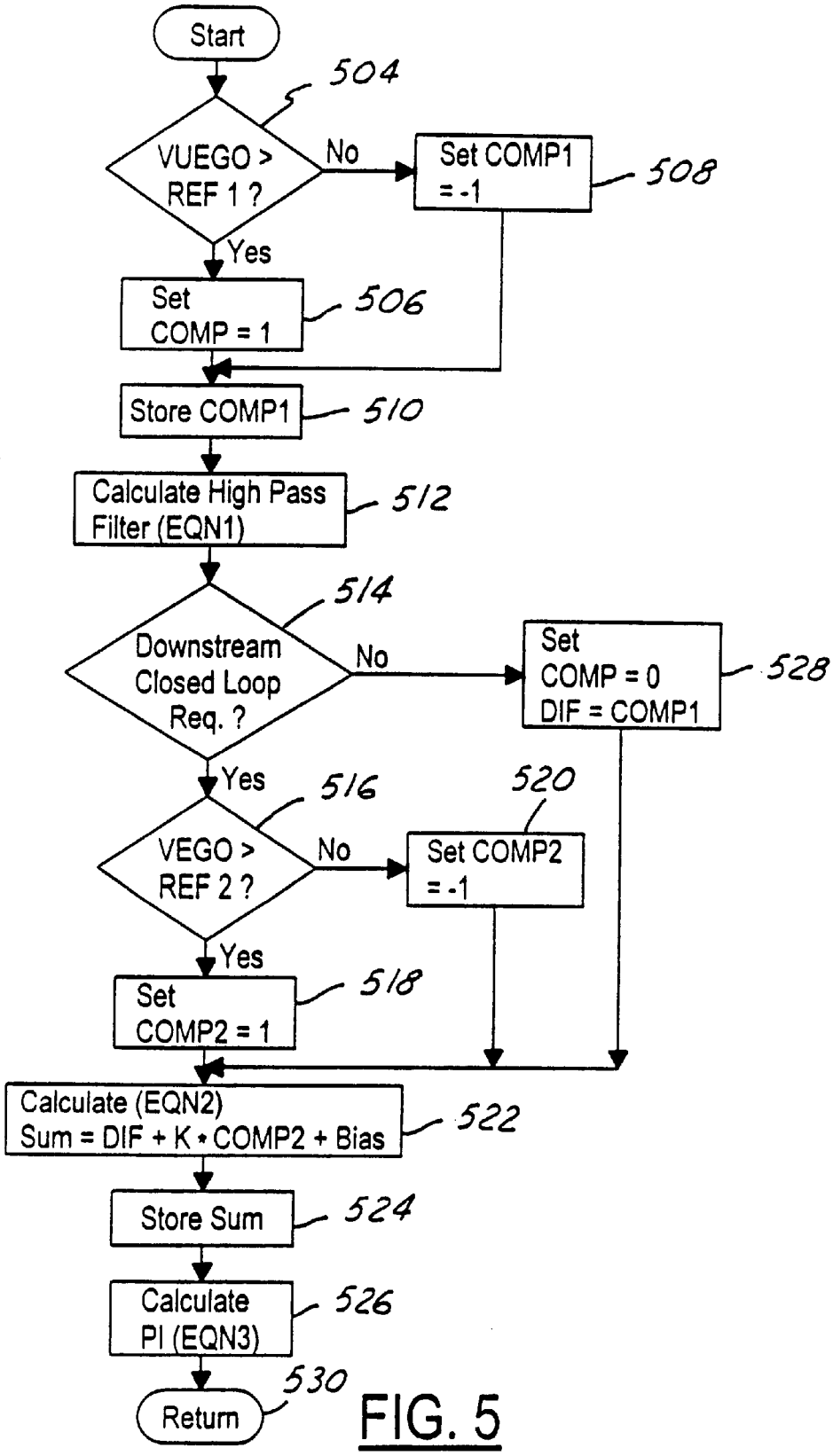
FIG. 5 is a flowchart illustrating various process steps performed to calculate an air/fuel ratio correction amount according to the invention.

The calculation of air/fuel ratio correction amount LAMCOR in step 408 is now described with particular reference to the flowchart shown in FIG. 5. Steps 504, 506, and 508 describe the first comparator 200 and compute its output COMP1. The value of COMP1 is stored in RAM 108 in step 510 for use in the next sampling interval. Step 512 performs computation pertinent to (Eqn.1) which describes high pass filter 204. Then, step 514 checks if downstream EGO sensor 130 is warmed up to start second closed loop operation and whether downstream closed loop control has been enabled as described later herein with particular reference to FIG. 7. These conditions are similar but may be different from the conditions for upstream UEGO sensor 128 provided above (see step 406). If said conditions are met, steps 506, 518, and 520 compute the output COMP2 of the second comparator 202.

Step 522 represents summing block 208 and computes (Eqn.2). The output value SUM from step 522 is stored in RAM 108 in step 524 for use in the next sampling interval. Step 526 performs computation pertinent to (Eqn.3) which describes PI controller 210. Step 530 returns this routine to step 412 of fuel flow calculations. If above mentioned conditions in step 514 are not met, step 528 sets COMP2 equal to 0, and P/F equal to COMP1 thus disabling the second closed loop operation and high pass filter. Step 528 then proceeds to step 522 providing automatic transfer from one EGO to dual EGO sensor closed loop fuel control.

As described later herein with respect to FIG. 7, when vehicle operating conditions call for non-stoichiometric operation of the vehicle engine 102, the downstream EGO sensor 130 is disabled. In such a case, the vehicle fuel control system 100 operates as a single upstream UEGO sensor 128 control system. At stoichiometry, the vehicle fuel control system 100 operates using both the UEGO 128 and the EGO 130 sensors, thus providing accurate fuel control for both stoichiometric and non-stoichiometric operation.

Figure 7:
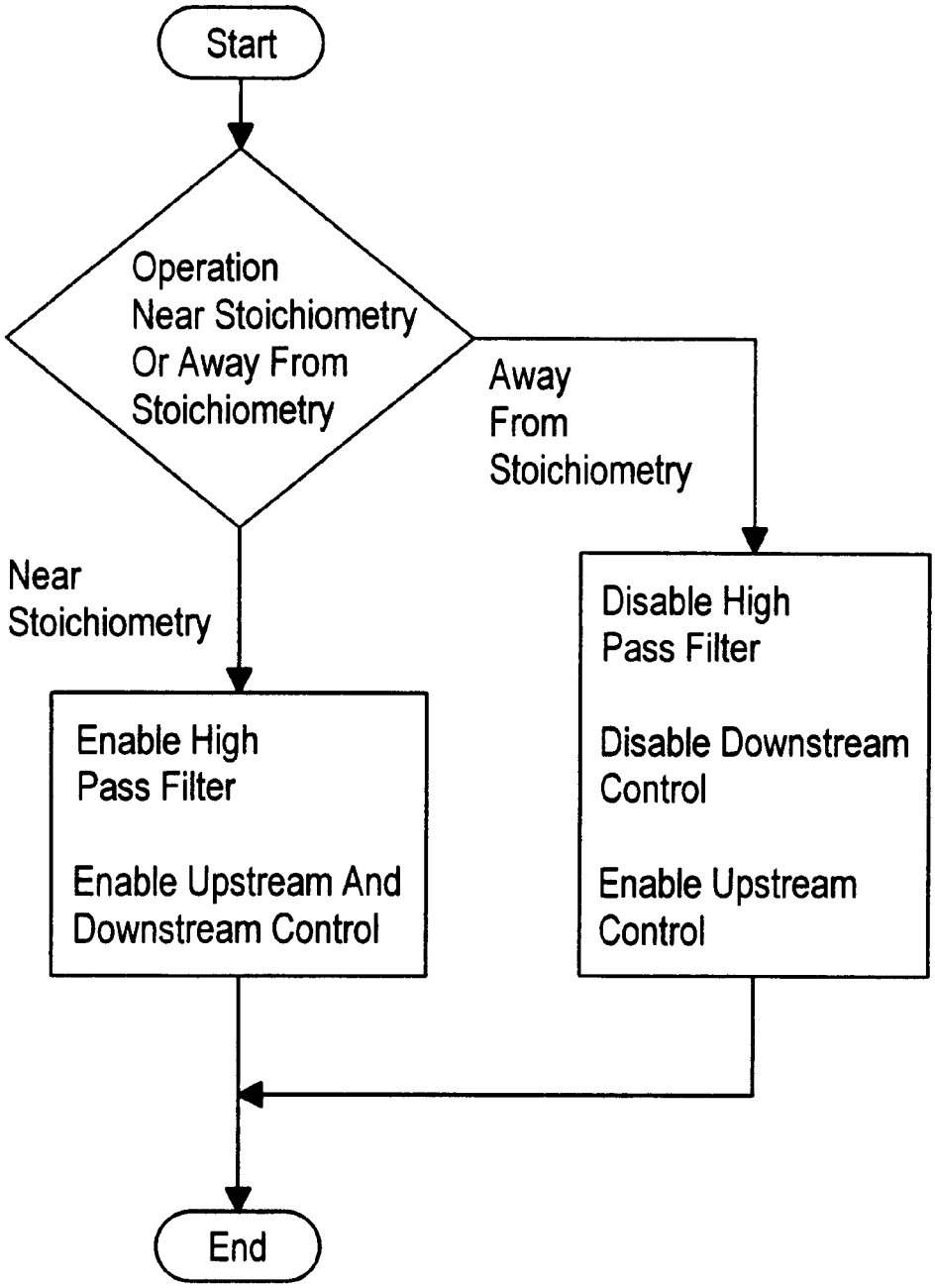
FIG. 7 is a flowchart illustrating various process steps performed to calculate an air/fuel ratio correction amount according to the invention.

Referring now to FIG. 7, a routine is described for enabling duel sensor air-fuel feedback control where upstream sensor measurements are filtered with a high pass filter or single sensor air-fuel feedback control where upstream sensor measurements are not filtered with a high pass filter. First, in step 710, a determination is made as to whether operation near stoichiometry or away from stoichiometry is desired. For example, lean operation may be desired during certain speed load operating points, where near stoichiometry may be desired at others. Also, alternating lean and rich operation may be desired to provide lean running capability where NOx is retained during lean operating and released/reduced during rich operating when the amount of NOx stored during lean operation reaches a predetermined limit.

When near stoichiometry is desired, the routine continue to step 712. In step 712, the high pass filter 204 is enabled and upstream and downstream feedback air-fuel ratio control is enabled. Otherwise, in step 714, high pass filter 204 is disabled, downstream feedback control is disabled, and upstream feedback control is enabled.

Thus, according to the present invention, disadvantages with prior approaches are overcome. For example, if prior approaches used two "switching" sensors (one upstream and one downstream of the emission control device), they have the disadvantage that air-fuel operation away from stoichiometry may not be accurately controlled since the feedback sensors simply indicate lean or rich, without an accurate measure of the air-fuel ratio away from stoichiometry. However, according to the present invention, it is possible to operate away from stoichiometry with accurate control via the upstream "linear" sensor, while at the same time obtain accurate control near stoichiometry via the downstream "switching" sensor in combination with the upstream "linear" sensor.

Further, according to the present invention accurate dual sensor control is obtained near stoichiometry via the high pass filter on the upstream "linear" sensor. Also, the high pass filter is disabled during operation away from stoichiometry. This provides an advantage, since many times operation away from stoichiometry is conducted at near-steady operation. In other words, if the high pass filter is used, which has a gain of near zero at steady state operation, almost no feedback control action would be provided. Thus, by disabling the high pass filter away from stoichiometry, it is possible to obtain good air-fuel ratio control.

Although several examples of embodiments which practice the invention have been described herein, there are numerous other examples which could also be described. For example, the invention can also be used with various types of emission control devices such as so-called lean burn catalyst.

What is claimed is:

1. A system for controlling engine air-fuel ratio entering an emission control device comprising:

a switching exhaust gas sensor located downstream of the emission control device;

a linear exhaust gas sensor located upstream of the emission control device; and a controller adjusting a fuel injection amount into the engine based on both said switching exhaust gas sensor and said linear exhaust gas sensor when operating near stoichiometry; and adjusting said fuel injection amount into the engine based on said linear exhaust gas sensor and independent of said switching exhaust gas sensor when operating away stoichiometry.

2. The system recited in claim 1 wherein said controller further adjusts said fuel injection amount into the engine based on said linear exhaust gas sensor and independent of said switching exhaust gas sensor when operating lean of stoichiometry.

3. The system recited in claim 1 wherein said controller further adjusts said fuel injection amount into the engine based on said linear exhaust gas sensor and independent of said switching exhaust gas sensor when operating rich of stoichiometry.

4. The system recited in claim 1 further comprising a high pass filter for filtering an output of said linear exhaust gas sensor during operation near stoichiometry.

5. A system for controlling engine air-fuel ratio entering an emission control device comprising:

a switching exhaust gas sensor located downstream of the emission control device;

a linear exhaust gas sensor located upstream of the emission control device; and a controller adjusting a fuel injection amount into the engine based on both said switching exhaust gas sensor and said linear exhaust gas sensor filtered with a high pass filter when operating near stoichiometry; and adjusting said fuel injection amount into the engine based on said linear exhaust gas sensor without high pass filtering and independent of said switching exhaust gas sensor when operating away stoichiometry.

6. The system recited in claim 5 wherein the engine is a direct injection engine.

7. The system recited in claim 5 wherein the emission control device retains oxidants during lean operation and releases said stored oxidants during rich operation.

8. The system recited in claim 5 wherein the high pass filter has substantially zero gain at substantially zero frequency.

9. The system recited in claim 8 wherein operating away from stoichiometry includes operating lean of stoichiometry.

10. The system recited in claim 9 wherein operating away from stoichiometry includes operating rich of stoichiometry.

11. A system for controlling engine air-fuel ratio entering an emission control device comprising:

a switching exhaust gas sensor located downstream of the emission control device;

a linear exhaust gas sensor located upstream of the emission control device; and a computer storage medium having a computer program encoded therein for controlling fuel injected into the engine, said computer storage medium comprising:

code for adjusting a fuel injection amount into the engine based on both said switching exhaust gas sensor and said linear exhaust gas sensor filtered with a high pass filter when operating near stoichiometry; and code for adjusting said fuel injection amount into the engine based on said linear exhaust gas sensor without high pass filtering and independent of said switching exhaust gas sensor when operating away stoichiometry.

12. The system recited in claim 11 wherein said computer storage medium further comprises code for filtering said linear exhaust gas sensor.

13. The system recited in claim 12 wherein said code for filtering further comprises code for filtering said linear exhaust gas sensor at substantially zero gain at substantially zero frequency.

* * * * *